United States Patent [19]

Matthews

[11] Patent Number: 4,824,380

[45] Date of Patent: Apr. 25, 1989

[54] QUICK DISCONNECT CONNECTOR AND SYSTEM WITH INTEGRAL CONDUCTOR

[75] Inventor: Russell H. Matthews, Modesto, Calif.

[73] Assignee: Elcon Products International Company, Fremont, Calif.

[21] Appl. No.: 124,747

[22] Filed: Nov. 24, 1987

[51] Int. Cl.[4] ..... H01R 9/09

[52] U.S. Cl. ..... 439/78; 439/176; 439/510; 439/80

[58] Field of Search ..... 439/63, 78, 80–84, 439/750, 603, 842, 834, 851–858, 884, 885, 889, 176, 510

[56] References Cited

U.S. PATENT DOCUMENTS

| | | | |
|---|---|---|---|
| 3,932,013 | 1/1976 | Yeager et al. | 439/510 |
| 4,010,993 | 3/1977 | Hohenberger et al. | 439/176 |
| 4,458,970 | 7/1984 | Fourreau et al. | 439/176 |
| 4,721,471 | 1/1988 | Mueller | 439/78 |

*Primary Examiner*—Gil Weidenfeld
*Assistant Examiner*—P. Austin-Bradley
*Attorney, Agent, or Firm*—Flehr, Hohbach, Test, Albritton & Herbert

[57] ABSTRACT

A modular connector (10) has a generally rectangular insulating housing (12). A one piece conductive member (14) is mounted within and extends from the housing (12). The conductive member (14) has a common conductive portion (16), compliant pin portions (18) extending from the common conductive portion (16), a socket portion (20) extending from the common conductive portion (16), and a tail portion (22) connected to a bus element (23). The socket portion (20) has a circular receptacle (24) in face (25) for receiving a mating pin contact (52) of another connector (10) and a plurality of tines (28) extending axially with respect to the receptacle (24) to engage the mating pin contact (52). The housing (12) has a substantially open bottom (30) having slots (32) along sides (34), which receive the pin portions (18) of the conductive member (14). An opening (36) in front (38) of the housing (12) receives the face (25) with the circular receptacle (24) at the front (38) with the tines (28) extending behind the circular receptacle in the housing (12). The housing (12) has an integrally formed arm (44) extending to one side of the housing. Arm (44) and housing (12) have a slot (46) extending along the length of the arm (44) and through the housing (12). The bus element (23) fits into the slot (46) when the conductive member (14) is inserted into the housing (12).

13 Claims, 4 Drawing Sheets

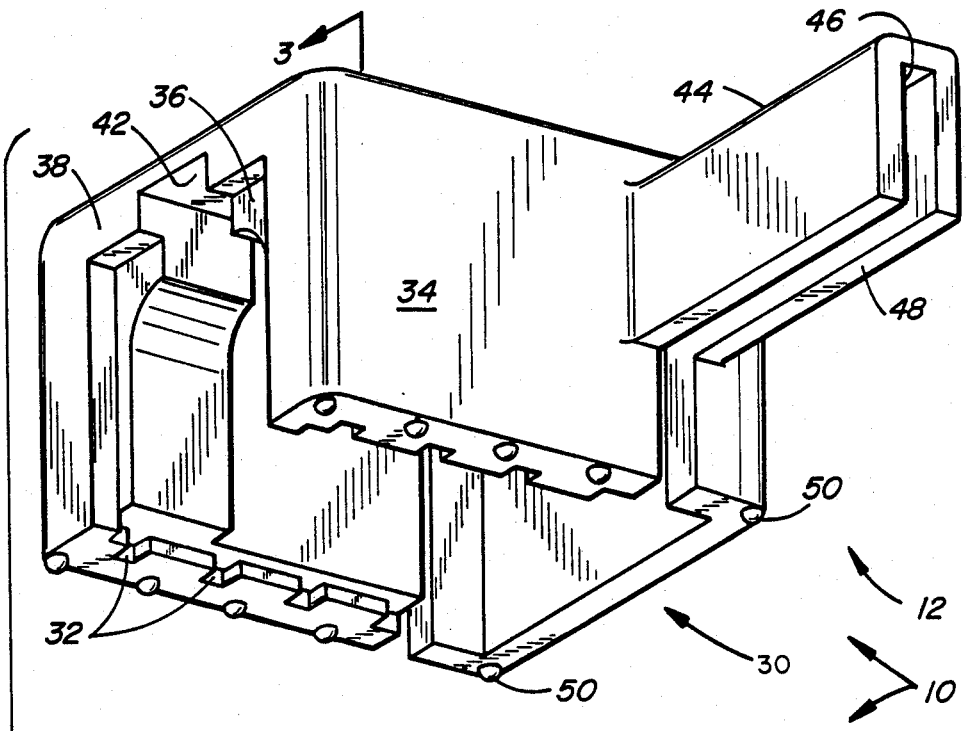
FIG._1.
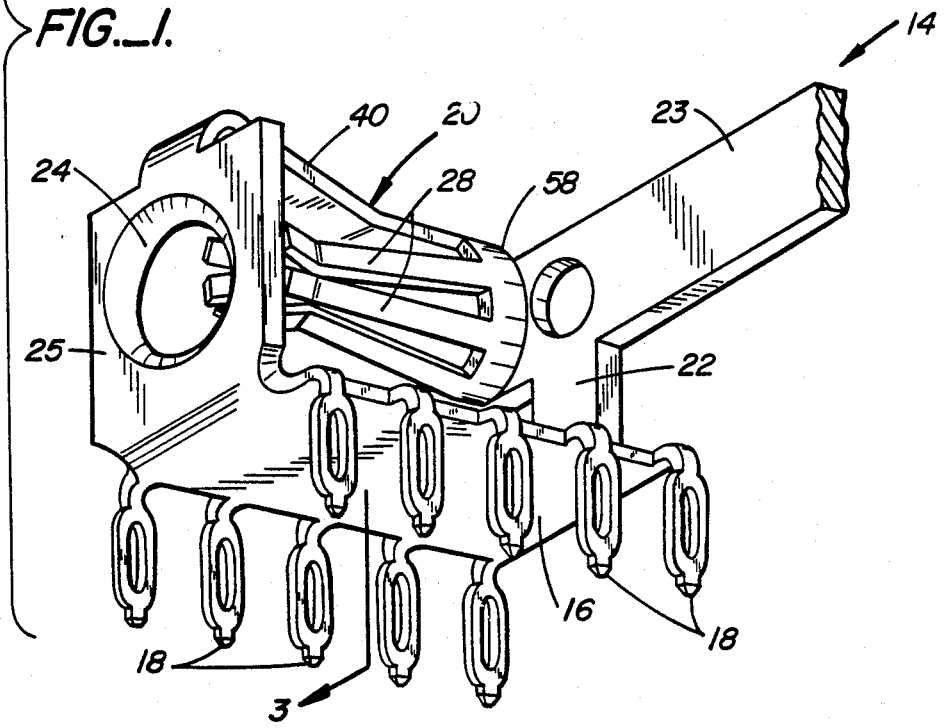

QUICK DISCONNECT CONNECTOR AND SYSTEM WITH INTEGRAL CONDUCTOR

CROSS REFERENCE TO RELATED APPLICATION

This application covers an improvement to the invention described in commonly assigned application Ser. No. 06/812,797, filed Dec. 23, 1985, in the name of Robert G. Foley and entitled "Circuit Board Connector, Bus and System."

BACKGROUND OF THE INVENTION

1. Field of the Invention

This invention relates to a modular connector system of the general type described in the above related application. More particularly, it relates to such a modular connector system having an improved conducting member configuration that enables the modular connectors of the system to be fabricated in high volume at reduced cost. Most especially, it relates to such a modular connector system having increased flexibility in the configurations in which it may be assembled.

2. Description of the Prior Art

The above related application describes a modular connector system in which connectors have an insulating block with a bus element supported by the insulating block. Contact pins are attached to the bus element and extend through the insulating block. An additional contact is electrically connected to the bus element and is configured to engage a mating contact of another connector of the modular connector system. This connector system has achieved substantial market acceptance because of its quick connect and disconnect capability and the different configurations in which the modular connectors of the system can be connected in use. However, in its present form, these modular connectors require the fabrication and assembly of a substantial number of different parts, which means that there is a substantial opportunity for fabrication cost reduction if the number of parts can be reduced and the assembly of the modular connectors can be simplified. Further flexibility in the different configurations in which the modular connectors could be connected would also increase the number of applications for the system. While the modular connector system of the related application represents a substantial improvement in its field, further development of its design will increase its value.

Another example of a prior art connector is commercially available from AMP Incorporated, Harrisburg, PA 17105, under the designation Power Tap. However, this product is not a quick disconnect connector. It relies on the use of a screw to hold a lug that is crimped to stripped wire.

SUMMARY OF THE INVENTION

Accordingly, it is an object of this invention to provide a modular connector system having a reduced number of parts making up conductor elements used in the modular connector system.

It is another object of the invention to provide such a modular connector system which can be connected together in an increased number of different configurations.

It is a further object of the invention to provide such a modular connector system in which a bus element, contact pins and a socket element of the modular connectors are provided in an integral form.

It is yet another object of the invention to provide such a modular connector system in which the bus element, contact pins and socket element are all contained within an insulated housing of the modular connector.

It is a still further object of the invention to provide such a modular connector system in which a common conductor element can extend between adjacent modular connectors without being in an exposed position for inadvertent electrical connection with other circuit elements.

The attainment of these and related objects may be achieved through use of the novel modular connector and system formed from the modular connector herein disclosed. A modular connector in accordance with the invention has a generally rectangular housing with a bottom and a conductive element substantially contained within the housing. The bottom of the housing has an opening dimensioned to allow insertion of the conductive element substantially within the housing. The conductive element has a bus element and a plurality of conductive pins extending downward from the bus element. The opening of the bottom of the housing has a like plurality of peripheral slots each configured to receive one of the plurality of conductive pins. The conductive element has a face connected to the bus element. The face has a socket opening and a plurality of contact tines connected to the face and positioned axially behind the socket opening. The housing has a surface in addition to the bottom with an aperture positioned facing the socket opening. At least the bus element, face and plurality of contact tines are integrally formed from a single metal member.

The attainment of the foregoing and related objects, advantages and features of the invention should be more readily apparent to those skilled in the art, after review of the following more detailed description of the invention, taken together with the drawings, in which:

BRIEF DESCRIPTION OF THE DRAWINGS

FIG. 1 is an exploded perspective view of a modular connector in accordance with the invention.

DETAILED DESCRIPTION OF THE INVENTION

Figure 2:
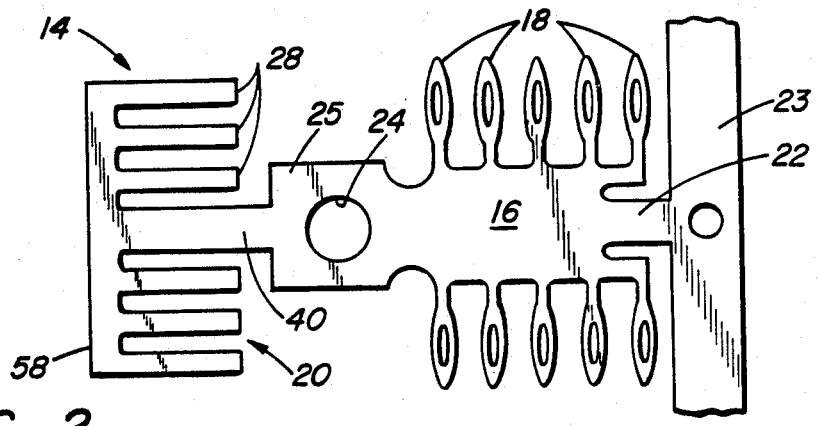
FIG. 2 is a plan view of an integral conductive element forming part of the modular connector of FIG. 1.

Turning now to the drawings, more particularly to FIGS. 1–3A, there is shown a modular connector 10 in accordance with the invention. The modular connector 10 has a generally rectangular insulating housing 12 formed from a suitable plastic, such as a polyester. A one piece conductive member 14 is mounted within and extends from the insulating housing 12. The one piece conductive member 14 has a common conductive portion 16, compliant pin portions 18 extending from the common conductive portion 16, a socket portion 20 extending from the common conductive portion 16, and a tail portion 22 connected to a bus element 23 when a plurality of the modular connectors 10 are to be connected in common. The socket portion 20 has a circular receptacle 24 in face 25 for receiving a mating pin contact 52 of another connector 10 and a plurality of tines 28 extending axially with respect to the receptacle 24 to engage the mating pin contact 52.

The housing 12 has a substantially open bottom 30 having slots 32 along sides 34, which receive the pin portions 18 of the conductive member 14. An opening 36 in front 38 of the housing 12 receives the face 25 with the circular receptacle 24 at the front 38 with the tines 28 extending behind the circular receptacle in the housing 12. Arm 40 joining the tines 28 to the face 25 extends above the face 25 to fit into extension 42 of the opening 36. The housing 12 has an integrally formed arm 44 extending to one side of the housing. Arm 44 and housing 12 have a slot 46 extending along the length of the arm 44 and through the housing 12. The slot 46 is open at bottom 48 of the arm 44 and bottom 30 of the housing 12. The bus element 23 fits into the slot 46 when the conductive member 14 is inserted into the housing 12. Stand-offs 50 on the bottom 30 of the housing 12 space the connector 10 above a printed circuit board or other structure into which the protruding ends of the pin portions 18 are inserted.

Figure 3:
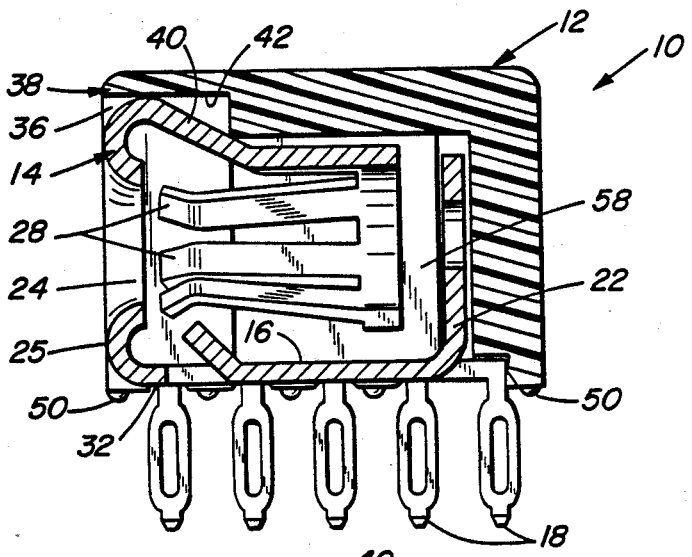
FIG. 3 is a cross-section view taken along the line 3—3 in FIG. 1.
Figure 3A:
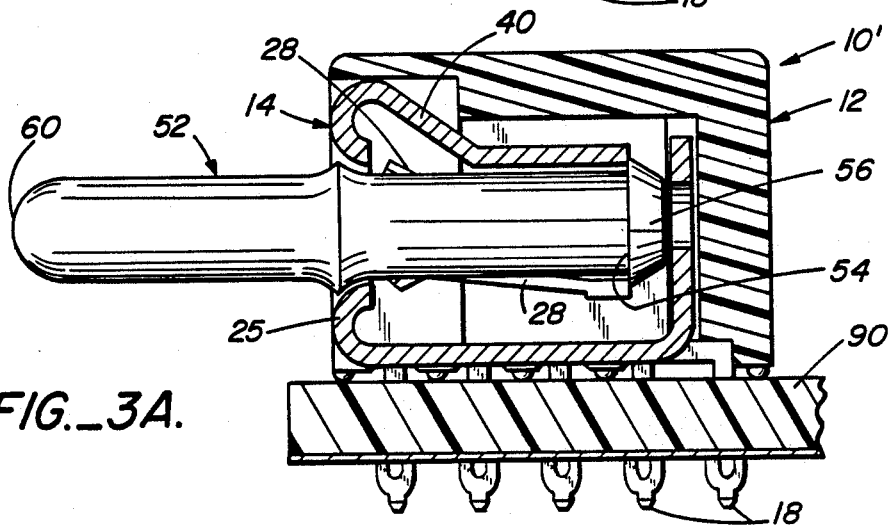
FIG. 3A is another cross-section view as in FIG. 3, but showing use of the FIG. 3 structure.

In fabrication of the connector 10, flat metal stock is formed in a stamping operation into the shape of the conductive member 14 as shown in FIG. 2. The flat metal stock is then bent on a suitable mandrel to the shape shown in FIGS. 1 and 3. To assemble the connector 10, the housing is placed over the bent conductive member 14 in a press fit, so that the conductive member 14 with the exception of the protruding pin portions 18 is contained within the housing 12. If a male contact is desired, a pin 52 is inserted into the circular receptacle 24 ito engagement with the tines 28, as shown in FIG. 3A. The pin 52 has a rib 54 around its base 56 which snaps into locking engagement with the arm 40 and the tines 28 at their base 58. To connect two of the connectors 10 together, tip 60 of the pin 52 is inserted into the circular receptacle and tines 28 of another connector 10.

Figure 4:
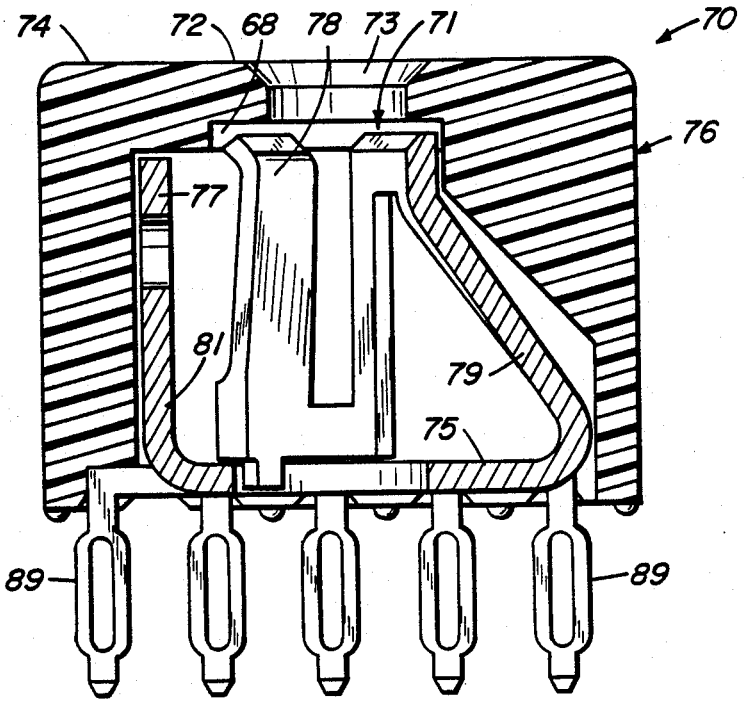
FIG. 4 is a cross-section view of a second configuration of a modular connector in accordance with the invention.

Connector 70 of FIG. 4 has essentially the same configuration as the connector 10 of FIGS. 1–3A, except that conductive member 71 is formed so that circular receptacle 72 extends from top 74 of the housing 76, with tines 78 supported by socket arm 79 extending axially with the circular receptacle 72 below the top 74. A common conductive member 75 is attached to bus portion 77 by tail 81. As in the connector 10, a pin 52 is inserted with its base 56 into the circular receptacle 72 and tines 78 when a male contact is desired. The circular receptacle 72 is chamfered at 73 to center the pin 52 when it is inserted in the circular receptacle 72. The circular receptacle 72 is shaped at 68 to provide support for the tines 78 from the plastic housing 76 behind the tines 78.

The sockets formed by the circular receptacles 24 and 72 and the tines 28 and 78, respectively, of the connectors 10 and 70 allow a relatively large amount of lateral movement of the pin 52 through flexure of the socket arms 40 and 79 and the contact tines 28 and 78. Such movement is important for accommodating misalignment, which becomes important when a host of connections are made simultaneously.

The conductive members 14 and 71 are one piece of metal. Therefore, no assembly of these parts is required, and there are no joints that introduce resistance to current flow. When the pin 52 is used to make male contacts, the tines 28 and 78 provide a multiplicity of contact points, reducing the constriction resistance to minimal values. Pin assembly is not labor intensive, since it is accomplished by merely pushing a pin into a socket.

The socket tines 28 and 78 are arranged such that stripe plating is possible if a precious metal contact is required in the sockets formed by the tines. Proper selection of metal alloys along with the one piece design offers an optimum contact spring characteristic with highest conductivity.

Figure 5:
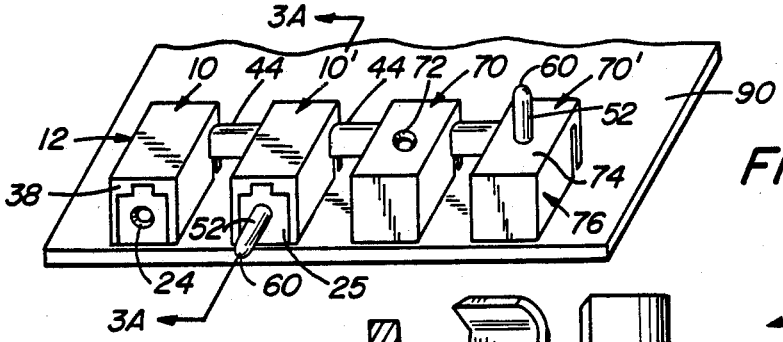
FIG. 5 is a perspective view of a connector system formed from the modular connectors of FIGS. 1–4.

FIG. 5 shows how the connectors 10 and 70 are mounted on a printed circuit board 90 (see also FIG. 3A) for both edge mounting and stack mounting, in either male or female configurations. The common conductive metal element 23 of the conductive members 14 in the two edge mounting connectors 10 is cut to length so that the conductive members 14 and the common element 23 are integrally formed, with the element 23 extending from the left connector 10 to the left stack mounting connector 70 within the housings 12 and the arms 44. Similarly, the corresponding bus element 75 and the conductive members 71 in the connectors 70 are integrally formed in one piece, with the conductive element 75 extending through the housings 76 to the conductive element 23 of the connectors 10. To make the connectors 10 and 70 electrically common, the conductive elements 23 and 75 are butt welded together at the left hand side of the left connector 70. To extend the system shown in FIG. 5, mating contacts of additional connectors 10 and 70 are plugged together edgewise or in stacked relationship, respectively.

Figure 6:
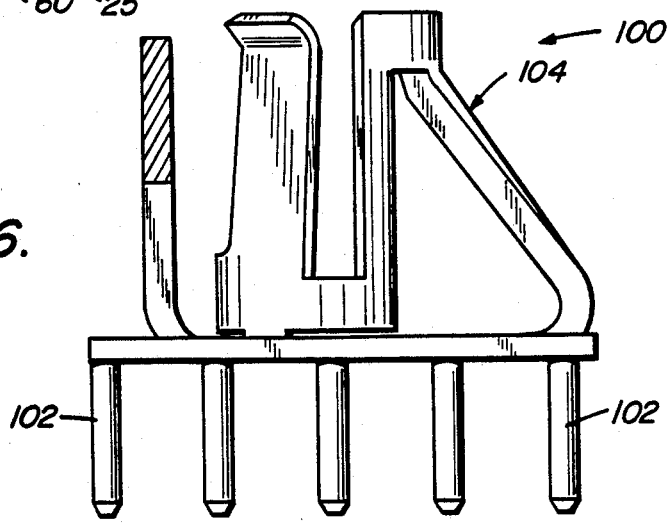
FIG. 6 is a cross-section view of a second embodiment of a modular connector in accordance with the invention.

FIG. 6 shows another conductive member 100 which can be used in a connector of the invention. The conductive member 100 has the same basic configuration as the conductive member 70 of FIG. 4, except that compliant pins 89 of the conductive member 70 have been replaced with conventional solid pins 102 for solder reflow attachment of the conductive member 104 on a circuit board. The conductive member 100 is formed from a single piece of metal in the same way as the conductive members 14 and 71 in the connectors 10 and 70. The housing 76 (FIG. 4) can be used with the conductive member 100. Other than as shown and described, the connector 100 has the same construction as the connector 70 of FIG. 4.

Figure 7:
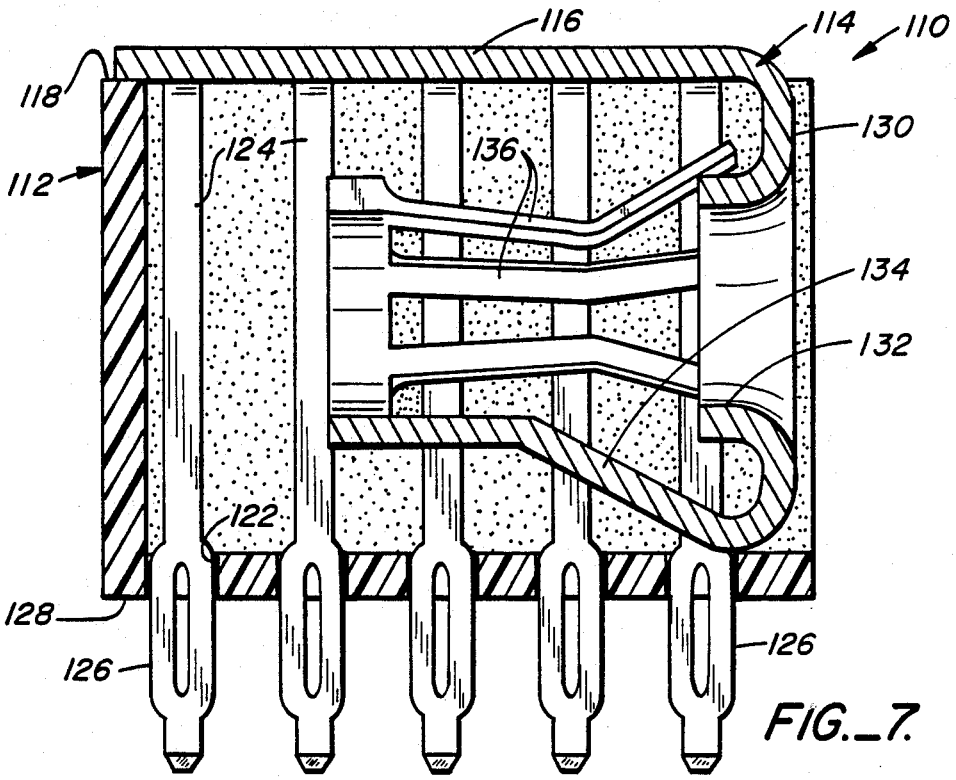
FIG. 7 is a cross-section view of a third embodiment of a modular connector in accordance with the invention.

FIG. 7 shows a third example of a connector 110 of the invention. The connector 110 has a housing 112 with external dimensions corresponding to those of the corresponding connector housings of the connectors described in the above referenced Foley pending application. Conductive member 114 has a bus portion 116 which rests on top 118 of the housing 112. The housing 112 has an opening 120 including slots 122 through which compliant pins 124 extend to pass through the housing 112 with tips 126 extending below bottom 128 of the housing. Face 130 of the conductive member with circular opening 132 and socket arm 134 supporting tines 136 extend through the opening 120 into the housing 112. As in the case of the connectors 10, 70 and 100, a pin 52 (FIG. 3A) has its base 56 inserted through the circular opening 132 into the tines 136 when a male connector is desired. The conductive member 114 is formed from a single piece of metal in the same way as the conductive member 14 of the connector 10. The connector 110 is configured for use without commoning to other connectors, i.e., it does not have a bus element extending to an adjacent connector. Similarly, the connectors of FIGS. 1-6 could be configured for use without commoning to adjacent connectors by eliminating the bus elements 23 and 75 and the arm 44. With the connectors of this invention, whether or not they have the bus elements 23 and 75 for commoning adjacent connectors, electrical power signals from or to the connectors can be bussed with discrete traces on a printed circuit board into which their pins are plugged.

Figure 8:
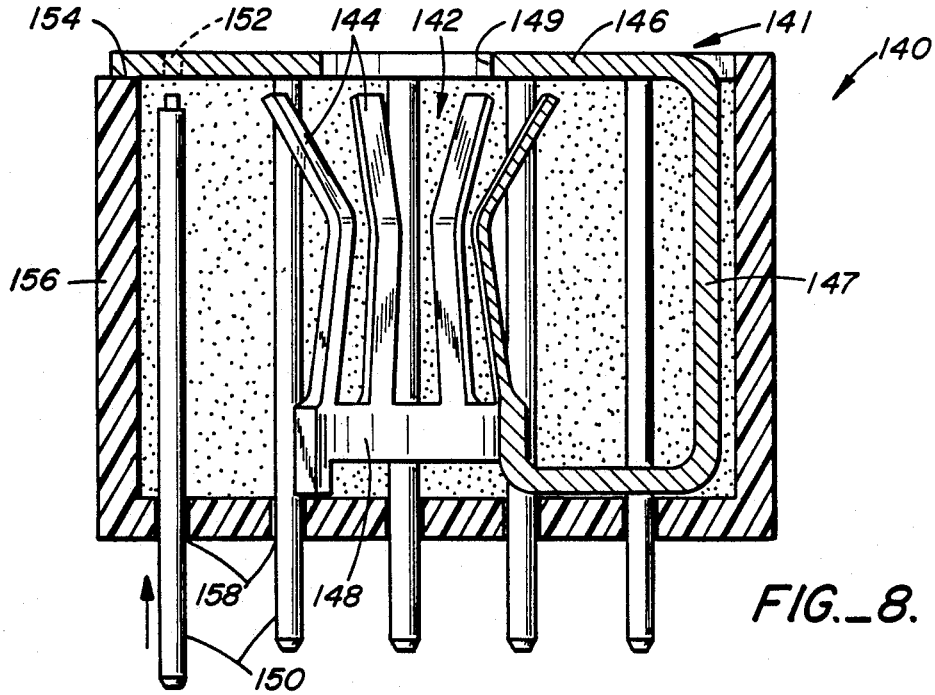
FIG. 8 is a cross-section view of a fourth embodiment of a modular connector in accordance with the invention.

FIG. 8 shows a fourth example of a connector 140 of the invention. The connector 140 has a conductive element 141 with an upwardly facing socket 142 having tines 144 connected to bus element 146 by socket arm 148. Opening 149 in the bus element 146 is aligned with the socket 142. Separate pins 150 are attached to the bus element 146 in holes 152. The bus element 146 rests on top 154 of housing 156, with the pins 152 passing through slots 158 of the housing 156. The pins 150 can have a round or square cross section or be compliant in configuration in the same manner as the pin portions 18 in FIGS. 1-3A. Like the connector 110, the connector 140 uses the housing 156 as disclosed in the above referenced Foley pending application.

It should now be readily apparent to those skilled in the art that a novel modular connector and system capable of achieving the stated objects of the invention has been provided. The integral conductor element of the connector substantially reduces assembly required to fabricate the connector and allows an increased number of connector configurations to be achieved with standardized components. The connector has its conductive elements contained within an insulated housing, even when a number of the connectors are connected together in common.

It should further be apparent to those skilled in the art that various changes in form and details of the invention as shown and described may be made. It is intended that such changes be included within the spirit and scope of the claims appended hereto.

What is claimed is:

1. A connector, which comprises a generally rectangular housing having a bottom and a conductive element substantially contained within said housing, the bottom of said housing having an opening dimensioned to allow insertion of said conductive element substantially within said housing, said conductive element having a common conductive portion and a plurality of conductive pins extending downward from the common conductive portion, the opening of the bottom of said housing having a like plurality of peripheral slots each configured to receive one of the plurality of conductive pins, said conductive element having a face connected to said common conductive portion; the face having a socket opening and a plurality of contact tines connected to the face and positioned axially behind the socket opening, said housing having a surface in addition to the bottom, the surface having an aperture positioned facing the socket opening, at least the common conductive portion, face and plurality of contact tines being integrally formed from a single metal member.

2. The connector of claim 1 in which said conductive element additionally comprises a socket arm connected between the face and the plurality of contact tines, the socket arm being integrally formed with the common conductive portion, face and plurality of contact tines from the single metal member.

3. The connector of claim 1 in which the surface of said housing is a side of said housing.

4. The connector of claim 1 in which the surface of said housing is a top of said housing.

5. The connector of claim 1 additionally comprising a male contact dimensioned for insertion in the socket opening and the plurality of contact tines, said male contact having a base shaped for locking engagement of the male contact in the plurality of contact tines with a tip of the male contact extending through the socket opening and the aperture beyond said housing.

6. A connector system comprising the connector of claim 5 and at least one additional connector in accordance with claim 1, the connector of claim 5 having the tip of the male contact inserted through the aperture of the housing and the socket opening into engagement with the plurality of contact tines of the additional connector.

7. The connector of claim 1 additionally comprising a bus element connected to said common conductive portion, said housing having an insulating arm laterally extending from a first side of said housing with a slot open at a bottom of the insulating arm, said bus element extending from within said housing into the laterally extending insulating arm, the slot passing through said housing, including through a second side of the housing opposite to the first side.

8. A connector system comprising the connector of claim 7 and at least one additional connector in accordance with claim 1, the additional connector having a slot on a side of said housing of the additional connector facing the insulating arm of the connector of claim 7, said bus element extending from the insulating arm through the slot of the additional connector into said housing of the additional connector, said conductive element of said additional connector being connected to said bus element.

9. An integrally formed, one piece metal conductive element for a connector, which comprises a common conductive portion, a socket opening in said common conductive portion, a plurality of contact tines positioned axially behind said socket opening, and a socket arm connected between said common conductive portion and said plurality of contact tines, said one piece metal conductive element additionally comprising a plurality of contact pins extending from said common conductive portion.

10. An integrally formed, one piece metal conductive element for a connector, which comprises a common conductive portion, a socket opening in said common conductive portion, a plurality of contact tines positioned axially behind said socket opening, and a socket arm connected between said common conductive portion and said plurality of contact tines, in combination with a male contact dimensioned for insertion in the socket opening and the plurality of contact tines, said male contact having a base with a laterally projecting portion shaped for locking engagement of the male contact in said plurality of contact tines without permanent modification of said integrally formed, one piece metal conductive element with the laterally projecting portion of said base behind said plurality of contact tines and in engagement with said socket arm to prevent removal of said male contact from said plurality of contact tines and a tip of the male contact extending forward through the socket opening.

11. An integrally formed, one piece metal and conductive element for a connector, which comprises a common conductive portion, a socket opening in said common conductive portion, a plurality of contact tines positioned axially behind said socket opening, and a socket arm connected between said common conductive portion and said plurality of contact tines, said common conductive portion including a first part and a face part extending substantially normal to the first part, said socket opening being in the face part, said socket arm being connected between the face part and said plurality of contact tines.

12. The integrally formed, one piece metal conductive element of claim 11 additionally comprising a bus element connected to and extending laterally of said common conductive portion.

13. The integrally formed, one piece metal conductive element for a connector of claim 11 in which said one piece metal conductive element additionally comprising a plurality of contact pins extending from said common conductive portion.

* * * * *